US011873702B2

(12) United States Patent
Nowitzki et al.

(10) Patent No.: US 11,873,702 B2
(45) Date of Patent: Jan. 16, 2024

(54) ELECTRIC SUBMERSIBLE PUMP (ESP) ASSEMBLY SHAFT-TO-SHAFT TETHERING

(71) Applicant: Halliburton Energy Services, Inc., Houston, TX (US)

(72) Inventors: Wesley Nowitzki, Tulsa, OK (US); Jason Eugene Hill, Tulsa, OK (US); Joshua Wayne Webster, Tulsa, OK (US); Casey Holden Bertram, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 134 days.

(21) Appl. No.: 17/696,286

(22) Filed: Mar. 16, 2022

(65) Prior Publication Data

US 2023/0296006 A1 Sep. 21, 2023

(51) Int. Cl.

| | |
|---|---|
| ***E21B 43/12*** | (2006.01) |
| ***F04D 29/043*** | (2006.01) |
| ***F04D 13/08*** | (2006.01) |
| ***E21B 43/38*** | (2006.01) |

(52) U.S. Cl.

CPC ..... *E21B 43/128* (2013.01); *E21B 43/38* (2013.01); *F04D 13/086* (2013.01); *F04D 29/043* (2013.01)

(58) Field of Classification Search

CPC .... E21B 43/128; E21B 33/0355; E21B 19/16; E21B 43/38; E21B 47/138; F04D 13/10; F04D 13/086; F04D 29/044; F04D 29/0405; F04D 29/026; F04D 13/021; F04D 29/126; F04D 29/054; F04D 13/08; F04B 47/06; F04B 17/03; F04B 39/14; F04B 49/06

See application file for complete search history.

(56) References Cited

U.S. PATENT DOCUMENTS

| | | | | |
|---|---|---|---|---|
| 7,775,779 | B2 | 8/2010 | Sheth et al. | |
| 9,394,750 | B2 | 7/2016 | Pisetskiy et al. | |
| 11,572,886 | B1 * | 2/2023 | Pyron | F04D 13/10 |
| 2002/0179305 | A1 | 12/2002 | Mack et al. | |
| 2009/0291001 | A1 | 11/2009 | Neuroth et al. | |

(Continued)

OTHER PUBLICATIONS

Foreign Communication from Related Application—International Search Report and Written Opinion of the International Searching Authority, International Application No. PCT/US2022/052920, dated Apr. 27, 2023, 11 pages.

*Primary Examiner* — Zakiya W Bates

(74) *Attorney, Agent, or Firm* — Conley Rose, P.C.; Rodney B. Carroll

(57) ABSTRACT

A method of lifting fluid by an electrical submersible pump (ESP) assembly in a wellbore. The method comprises positioning a first ESP component above the wellbore, wherein the first ESP component comprises a first drive shaft; positioning a second ESP component above the first ESP component, wherein the second ESP component comprises a second drive shaft; coupling a tethering assembly at a first end to an end of the first drive shaft proximate to the first flange; passing the tethering assembly through a coupling shell; coupling a second end of the tethering assembly to an end of the second drive shaft proximate to the second flange, wherein the tethering assembly is coupled slidingly to the first drive shaft or to the second drive shaft; coupling the first drive shaft to the second drive shaft by the coupling shell; and coupling the first flange to the second flange.

21 Claims, 9 Drawing Sheets

(56) References Cited

U.S. PATENT DOCUMENTS

| | | | | |
|---|---|---|---|---|
| 2010/0150751 | A1* | 6/2010 | Merrill | H02K 5/132<br>277/336 |
| 2011/0171047 | A1 | 7/2011 | Parmeter et al. | |

* cited by examiner

ELECTRIC SUBMERSIBLE PUMP (ESP) ASSEMBLY SHAFT-TO-SHAFT TETHERING

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pump (ESP) assemblies may be installed in wellbores to lift fluid in the wellbore, for example lift the fluid in a production tubing installed uphole of the ESP assembly. The ESP assembly may comprise an electric motor, a seal unit coupled to the electric motor uphole of the electric motor, and a pump assembly coupled to the seal unit uphole of the electric motor. The pump assembly may comprise one or more centrifugal pump stages, where each pump stage comprises an impeller and a diffuser. Typically, a drive shaft of the electric motor couples to a drive shaft in the seal unit, and the drive shaft in the seal unit couples to a drive shaft in the pump assembly, whereby rotational power is delivered by the electric motor to the pump assembly. More particularly, the impeller or impellers are coupled to the drive shaft in the pump assembly and impart energy and pressure to the fluid, and the diffusers direct the fluid to the next stage's impeller or into the production tubing. It is understood that other ESP components can be part of the ESP assembly in different environments. For example, in some cases a gas separator may be placed uphole of the seal unit and downhole of the pump assembly. In this case, the drive shaft of the seal unit couples to a drive shaft in the gas separator, and the drive shaft in the gas separator couples to the drive shaft in the pump assembly. In some installations a sensor package or sensor unit may be coupled to the ESP assembly downhole of the electric motor. An electric power cable may be coupled to the electric motor and extend to a surface to an electric power supply at the surface, for example a variable speed drive or other source of electric power.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
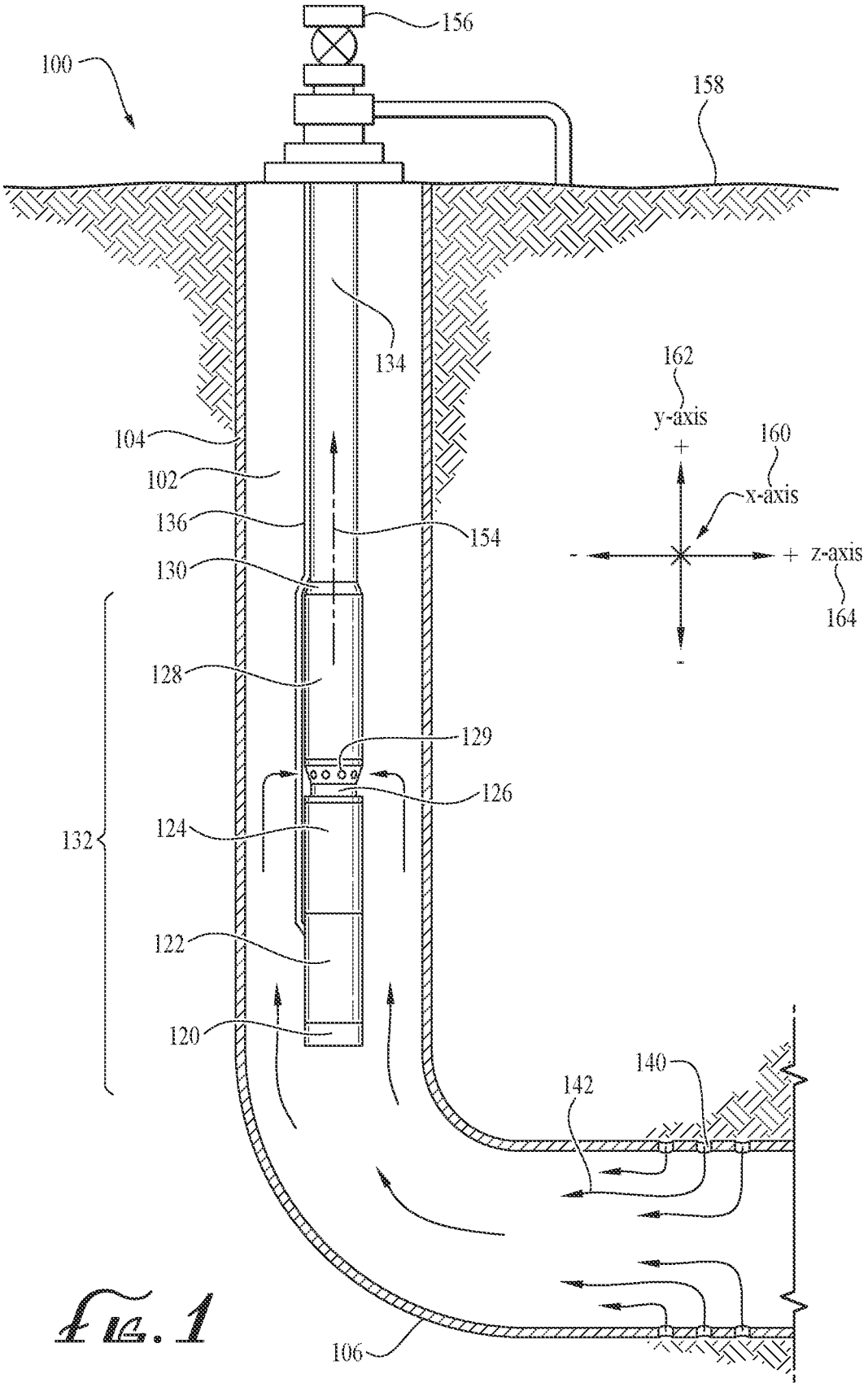
FIG. 1 is an illustration of an electric submersible pump (ESP) assembly in a wellbore according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

Electrical submersible pump (ESP) assemblies may be operated for extended periods of time in a wellbore, for example two years, three years, four years, even five years or more. Such extended ESP assembly service lives provide benefits to operators, but sometimes the ESP assembly can become damaged and weakened over time in the harsh downhole environment and may experience separation of components when removing the ESP assembly from the wellbore. Such a separation can be costly to the operator and highly dangerous to workers. For example, in one case an ESP assembly had been nearly recovered when the ESP assembly separated at a joint between two ESP assembly components. The lower part of the ESP assembly, including the electric motor, began to fall down the wellbore uncontrollably. The power cable which was still attached to the pothead near the electric motor unwound off of a spool with furious speed, threatening to injure nearby workers as the power cable whiplashed around. After the separated component reaches the bottom of the wellbore it must then be fished out of the wellbore before production of formation fluids (e.g., hydrocarbons such as gas and/or crude oil) can be resumed. Fishing for separated tools downhole can be a time consuming and expensive process.

The present disclosure teaches a new tethering assembly that tethers together two adjacent ESP components (e.g., tethers an electric motor to a seal section, tethers a seal section to a gas separator or a pump assembly, tethers a gas separator to a pump assembly). A plurality of tethering assemblies can be used to tether together three or more ESP components. For example, a first tethering assembly can tether an electric motor to a seal section, a second tethering assembly can tether the seal section to a gas separator, and a third tethering assembly can tether the gas separator to a pump assembly. The tethering assembly allows some axial motion of the two tethered ESP components relative to each other but defines a limit to the axial motion that can occur before the tether assembly stops the axial motion, at least without the tethering assembly breaking and thereby experiencing mechanical failure. In this way, the tethering assembly can prevent losing separated ESP components in the wellbore. Two ESP components may still separate, but the tethering assembly can allow the ESP component or components below the separation to be drawn uphole, via the tethering assembly by the ESP component above the separation. This tethering assembly can increase safety by avoiding uncontrolled falling of portions of the ESP assembly into the wellbore as a result of a separation and can reduce costs that would otherwise be entailed in fishing operations.

In an embodiment, the tethering assembly is provided by a tie rod system that couples together drive shafts of components of an ESP assembly such that if the two components separate, the tie rod can tether the lower component to the upper component. The tie rod can pass through a coupling shell that rotationally couples the drive shaft of the upper component to the drive shaft of the lower component. In an embodiment, the upper end of the tie rod can be secured to the drive shaft of the upper component. A shaft plug having a center through-hole can be slid over the lower end of the tie rod. The lower end of the tie rod can be secured to a tie rod stop. The shaft plug can then be secured to the drive shaft of the lower component. In this arrangement, the tie rod can slide through the coupling shell and slide through the through-hole in the shaft plug, and the tie rod stop and lower end of the tie rod can slide inside a bore in the drive shaft of the lower component. These sliding relationships are referred to herein as coupling the tethering assembly slidingly to the drive shaft of the lower component. The upper component can then be attached to the lower component, for example by bolts. If the lower component later becomes separated from the upper component (e.g., the bolts fail or loosen), the lower component can fall only until the tie rod and tie rod stop slide up within the bore of the drive shaft of the lower component to a point where the tie rod stop is butted up against the shaft plug. In this way, the tie rod tethers the lower component to the upper component and prevents dropping the lower component down the wellbore.

It is understood that in another embodiment, the location and disposition of the tie rod, the tie rod stop, and the shaft plug can be reversed. In this other embodiment, the lower end of the tie rod can be secured to the drive shaft of the lower component. A shaft plug having a center through-hole can be slid over the upper end of the tie rod, above the plate of the coupling shell. The upper end of the tie rod can be secured to a tie rod stop. The shaft plug can then be secured to the drive shaft of the upper component. In this arrangement, the tie rod can slide through the through-hole in the plate of the coupling shell and the through-hole in the shaft plug, and the tie rod stop and end of the tie rod can slide inside a bore in the drive shaft of the upper component. The upper component can then be attached to the lower component, for example by bolts. In an embodiment, the tie rod can be replaced by a multi-strand cable. In an embodiment, other tethering assemblies may be used to slidingly couple the upper component to the lower component.

Turning now to FIG. 1, a wellsite 100 is described. The wellsite 100 comprises a wellbore 102 optionally lined with a casing 104, an electric submersible pump (ESP) assembly 132 in the wellbore 102, and a production tubing string 134. The ESP assembly 132 comprises an optional sensor unit 120 at a downhole end, an electric motor 122 coupled to the sensor unit 120 uphole of the sensor unit 120, a seal section 124 coupled to the electric motor 122 uphole of the electric motor 122, a fluid intake 126 coupled to the seal section 124 uphole of the seal section 124, a pump assembly 128 coupled to the fluid intake 126 uphole of the fluid intake 126, and a pump discharge 130 coupled to the pump assembly 128 uphole of the pump assembly 128. The pump discharge 130 is coupled to the production tubing string 134. In an embodiment, a motor head or pot head (not shown) is coupled between the electric motor 122 and the seal section 124.

In an embodiment, the casing 104 has perforations 140 that allow reservoir fluid 142 to enter the wellbore 102 and flow downstream to the fluid intake 126. The reservoir fluid 142 enters inlet ports 129 of the fluid intake 126, flows from the fluid intake 126 into an inlet of the pump assembly 128, is pumped by the pump assembly 128 to flow out of the pump assembly 128 into the pump discharge 130 up the production tubing string 134 to a wellhead 156 located at the surface 134. In an embodiment, an electric cable 136 is connected to the electric motor 122 and provides electric power from an electric power source located at the surface 158 to the electric motor 122 to cause the electric motor 122 to turn and deliver rotational power to the pump assembly 128. In an embodiment, the electric cable 136 attaches to the electric motor 122 via a motor head or pot head.

In an embodiment, the pump assembly 128 comprises one or more centrifugal pump stages, where each centrifugal pump stage comprises an impeller coupled to a drive shaft of the pump assembly 128 and a diffuser retained by a housing of the pump assembly 128. An upper end of a drive shaft of the electric motor 122 is coupled to a lower end of a drive shaft of the seal section 124. An upper end of the drive shaft of the seal section 124 is coupled to a lower end of the drive shaft of the pump assembly 128. Rotational power is transferred from the drive shaft of the electric motor 122 to the drive shaft of the seal section 124 and from the drive shaft of the seal section 124 to the drive shaft of the pump assembly 128. In some contexts, the pump assembly 128 may be referred to as a centrifugal pump assembly. The pump assembly 128 may be said to lift the reservoir fluid 154 via the production tubing 134 to the surface 158.

In an embodiment, the ESP assembly 132 may comprise additional components. For example, the ESP assembly 132 may comprise a gas separator component uphole of the fluid intake 126 and downhole of the pump assembly 128. In this case, an upper end of the fluid intake 126 may be coupled to a lower end of the gas separator, and an upper end of the gas separator may be coupled to a lower end of the pump assembly 128. The gas separator may comprise a drive shaft that is coupled at a lower end to the upper end of the drive shaft of the seal section 124 and that is coupled at an upper end to the lower end of the drive shaft of the pump assembly 128. For example, the ESP assembly 132 may comprise a charge pump component uphole of the fluid intake 126 and downhole of the gas separator. The charge pump may impart energy and velocity to the reservoir fluid 142 to improve the performance of the gas separator. In this case, the upper end of the fluid intake 126 may be coupled to a lower end of the charge pump, and an upper end of the charge pump may be coupled to the lower end of the gas separator. The charge pump may comprise a drive shaft that is coupled at a lower end to the upper end of the drive shaft of the seal section 124 and that is coupled at an upper end to the lower end of the gas separator.

Each of the electric motor 122, the seal section 124, the pump assembly 128, the optional gas separator, and the optional charge pump may be said to be ESP components. It is a teaching of the present disclosure that a tie rod may be used to tether any of these ESP components to each other, via the drive shafts of the components, so as to prevent a part of the ESP assembly 132 from falling downhole in the event of a separation of the ESP assembly 132. This tie rod and associated structures are described below with reference to FIG. 2A, FIG. 2B, FIG. 2C, FIG. 2D, and FIG. 2E.

An orientation of the wellbore 102 and the ESP assembly 132 is illustrated in FIG. 1 by an x-axis 160, a y-axis 162, and a z-axis 164. While the wellbore 102 is illustrated in FIG. 1 as having a deviated portion or a substantially horizontal portion 106, the ESP assembly 132 may be used in a substantially vertical wellbore 102. While the wellsite 100 is illustrated as being on-shore, the ESP assembly 132 may be used in an off-shore location as well.

Turning now to FIG. 2A, FIG. 2B, FIG. 2C, FIG. 2D, FIG. 2E, and FIG. 2F, further details of the ESP assembly 132 are described. In an embodiment, an upper component 170 comprises a first drive shaft 174 (see FIG. 2A) that has male splines 176 and a bore 178 having female threads. The upper component 170 comprises a base 172 that defines bolt holes 179. In some contexts, the base 172 may be referred to as a flange or a collar. In an embodiment, a lower component 180 comprises a head 182, a second drive shaft 184 that has male splines 185, a bore 186 having female threads 188 at its upper end. In some contexts the head 182 may be referred to as a flange or a collar. The head 182 defines threaded holes 189. When coupling the upper component 170 to the lower component 180, bolts 199 (shown in FIG. 2E) pass through the bolt holes 179 in the base 178 of the upper component 170 and threadingly mate with the threaded holes 189 to attach the upper component 170 to the lower component 180. In some contexts, the first drive shaft 174 may be referred to as a first axial drive shaft, and the second drive shaft 184 may be referred to as a second axial drive shaft.

In an embodiment, the lower component 180 may be the electric motor 122, and the upper component 170 may be the seal section 122. In an embodiment, the lower component 180 may be the seal section 122, and the upper component may be the pump assembly 128. In an embodiment, the lower component 180 may be the seal section 124, and the upper component may be a gas separator. In an embodiment, the lower component 180 may be a gas separator, and the upper component may be the pump assembly 128. In an embodiment, the lower component may be the seal section 124, and the upper component 170 may be a charge pump. In an embodiment, the lower component 180 may be a charge pump, and the upper component 170 may be a gas separator. In an embodiment, the lower component 180 may be a first electric motor 122 and the upper component 170 may be a second electric motor 122 (e.g., a tandem motor configuration). In an embodiment, the lower component 180 may be a first seal section 122 and the upper component 170 may be a second seal section 122 (e.g., a tandem seal section). In an embodiment, the lower component 180 may be a first gas separator and the upper component 170 may be a second gas separator (e.g., a tandem gas separator). In an embodiment, the lower component 180 may be a first pump assembly 128 and the upper component 170 may be a second pump assembly 128 (e.g., a tandem pump assembly). In an embodiment, the coupling between drive shafts of any two adjacent ESP components may axially coupled to each other by a tethering assembly as described herein.

When assembling the ESP assembly 132, a tie rod 190 (see FIG. 2B) may be coupled to the first drive shaft 174. For example, an upper end of the tie rod 190 may have male threads that threadingly couple with female threads 178 in an axial central bore in a lower end of the first drive shaft 174. Alternatively, the upper end of the tie rod 190 may have a beveled upper edge and a circumferential groove on an outside diameter of the tie rod that inserts into and couples with a retaining ring held in a circumferential groove on an inside diameter of a central bore in the lower end of the first drive shaft 174. In an embodiment, the tie rod 190 may be an integral part of the first drive shaft 174, for example machined out of a continuous piece of metal. In an embodiment, the tie rod 190 may be welded to a lower end of the first drive shaft 174.

The tie rod 190 may pass through a central plate 194 of a coupling shell 192 (see FIG. 2C) that has female splines 171 in its interior. Alternatively, in an embodiment, the coupling shell 192 may not have a central plate. Upper female splines of the coupling shell 192 may mate with the male splines 176 of the first drive shaft 174, and lower female splines of the coupling shell 192 may mate with the male splines 185 of the second drive shaft 184. The full mating of the male splines 176, 185 with the female splines of the coupling shell 192 may not occur until later in a process of coupling the upper component 170 to the lower component 180. The coupling shell rotationally couples the first drive shaft 174 to the second drive shaft 184. A shaft plug 198 may have a through-hole that passes over the tie rod 190 below the central plate 194 of the coupling shell 192. A tie rod stop 196 may be coupled to a lower end of the tie rod 190. The tie rod stop 196 may have female threads 197 that threadingly couple to male threads 191 on an outside diameter of the lower end of the tie rod 190. Alternatively, the tie rod stop 196 may couple to the tie rod 190 using a retaining ring disposed in an interior circumferential groove in a central bore of the tie rod stop 196 and the retaining ring may pass over a beveled lower end of the tie rod 190 and engage with an exterior circumferential groove of the lower end of the tie rod 190. Alternatively, the tie rod stop 196 may couple to the tie rod 190 with one or more pins. The shaft plug 198 may have male threads 193 on an outside diameter that couple threadingly with female threads 188 at the top of a central bore 186 of the upper end of the second drive shaft 184. The shaft plug 198 may be tightened using a spanner wrench.

Figure 2A:
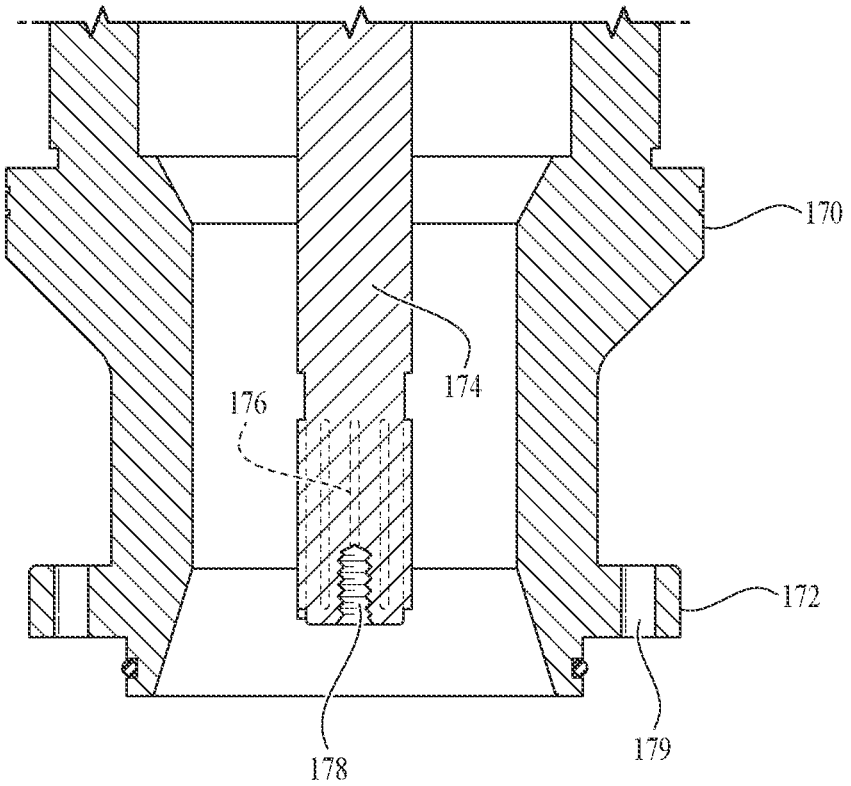
FIG. 2A, FIG. 2B, FIG. 2C, FIG. 2D, FIG. 2E, and FIG. 2F are illustrations of different phases of tethering drive shafts of two components of an ESP assembly together according to an embodiment of the disclosure.
Figure 2A:
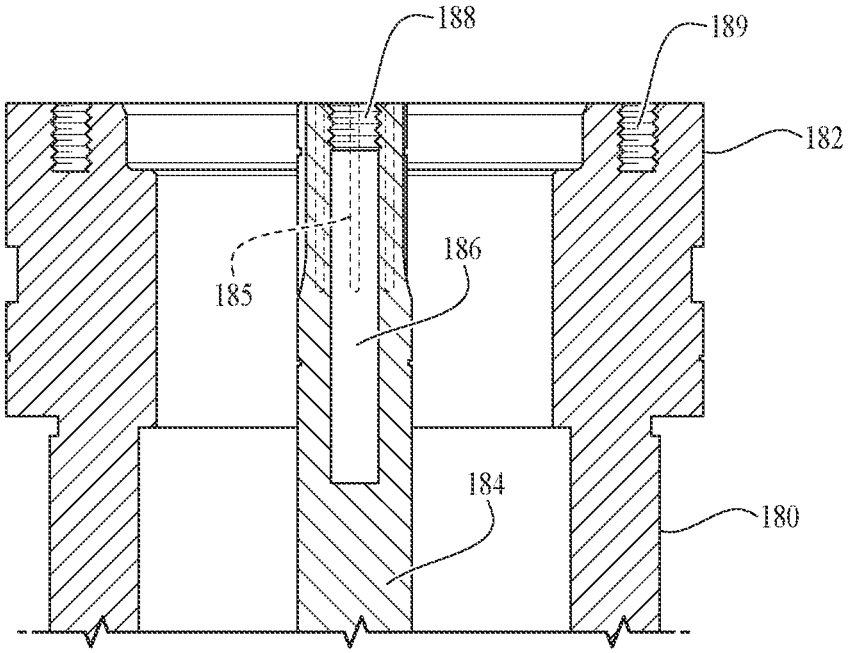
Figure 2B:
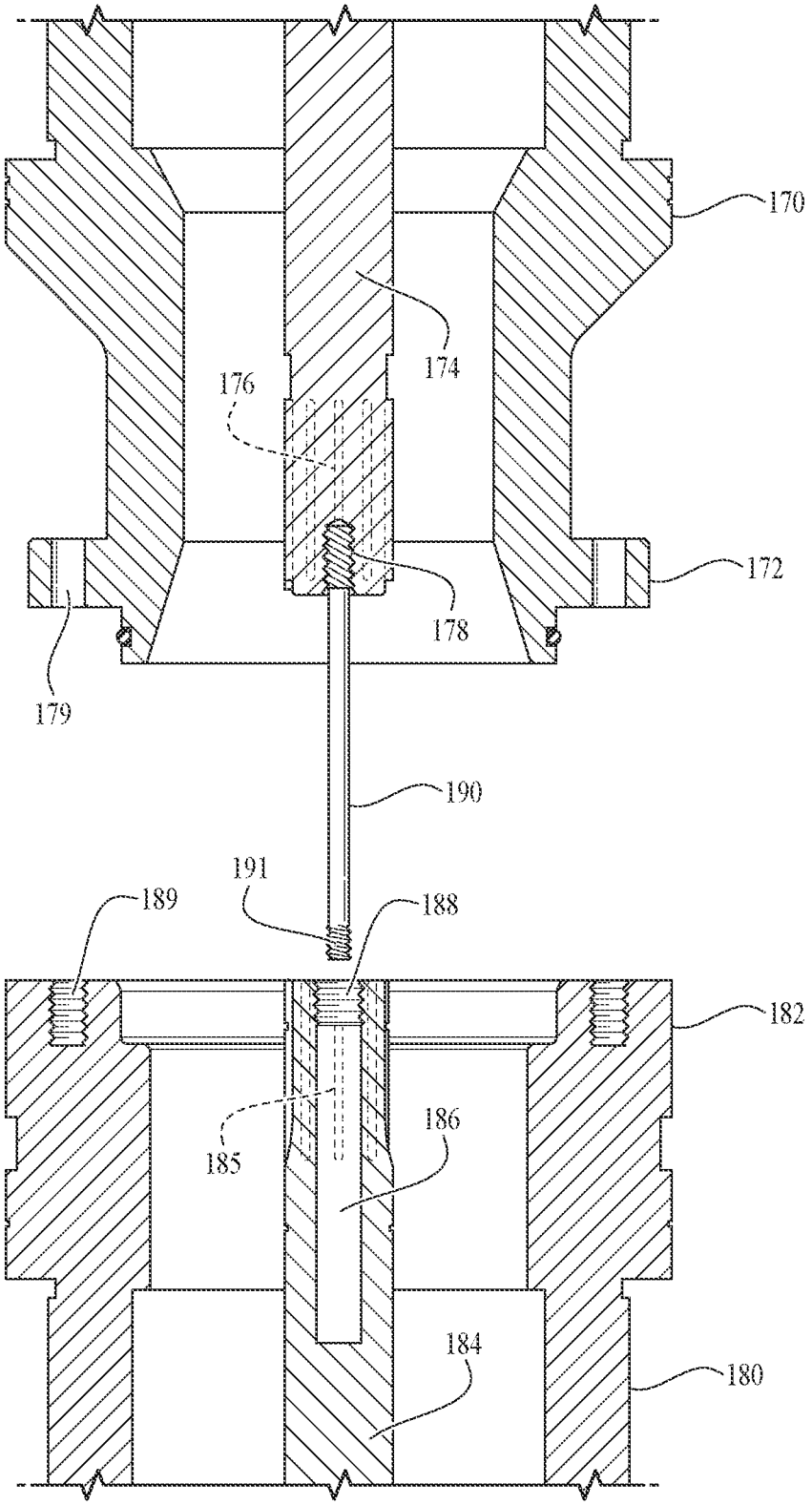
Figure 2C:
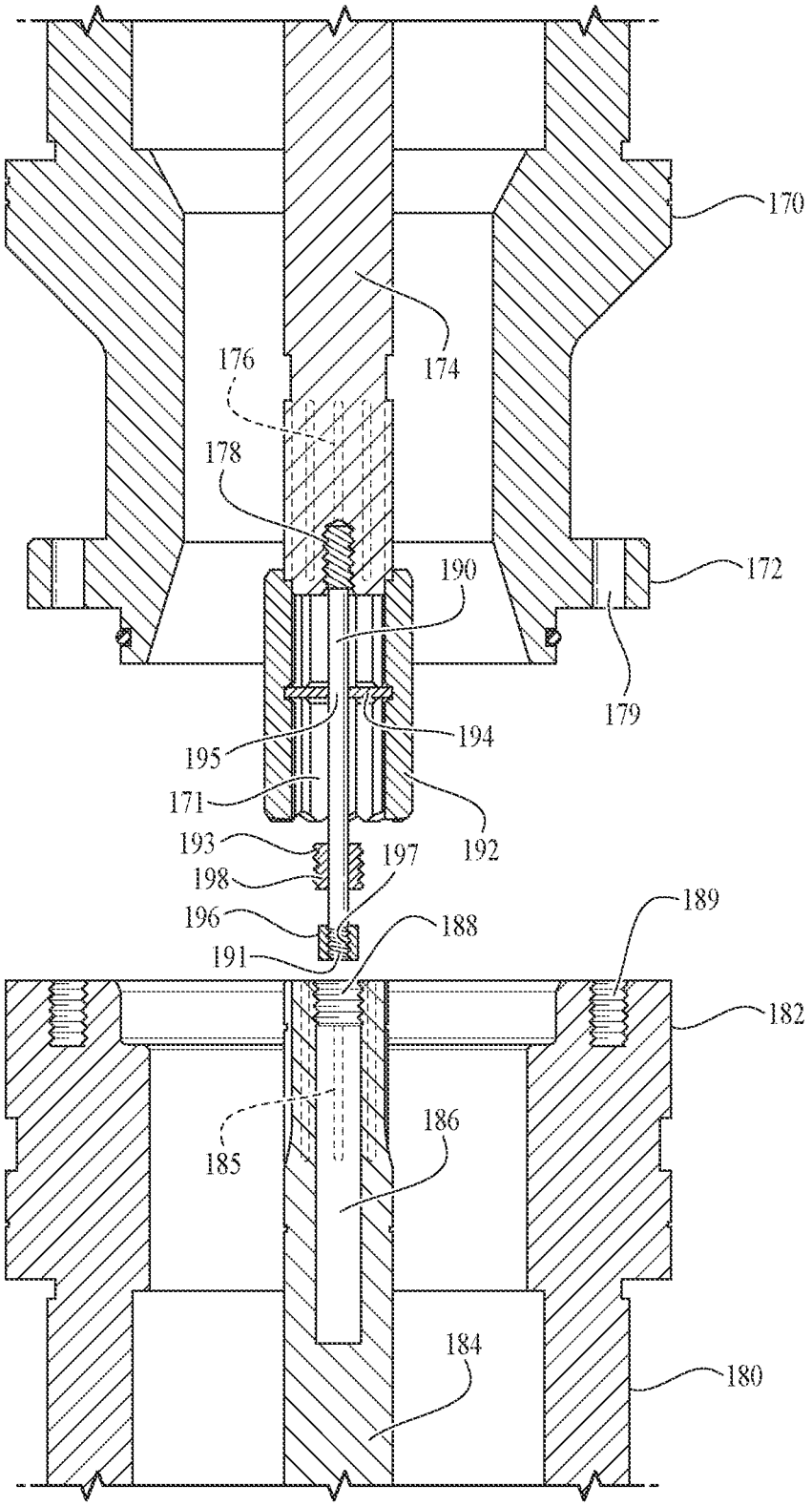
Figure 2D:
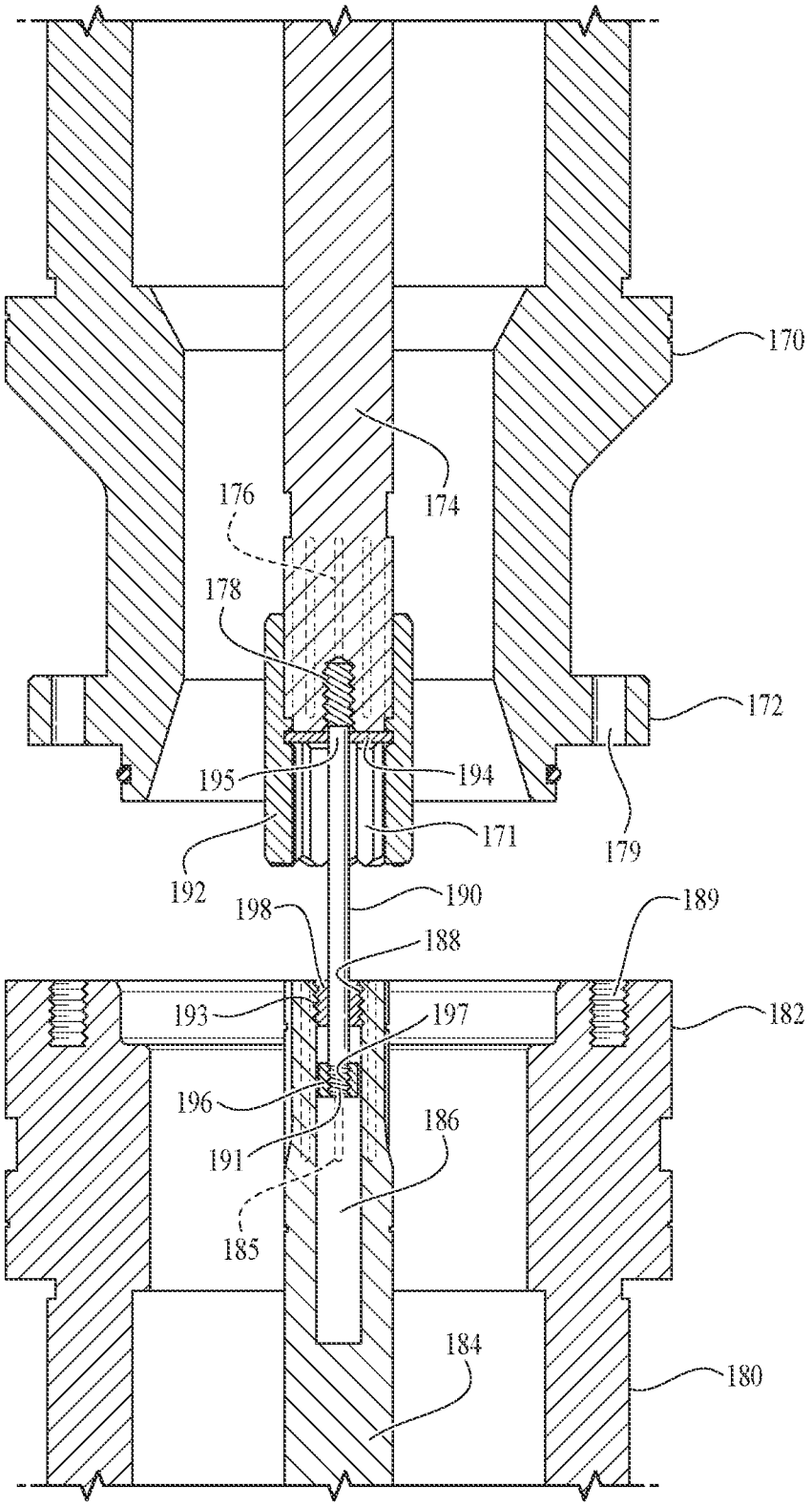
Figure 2E:
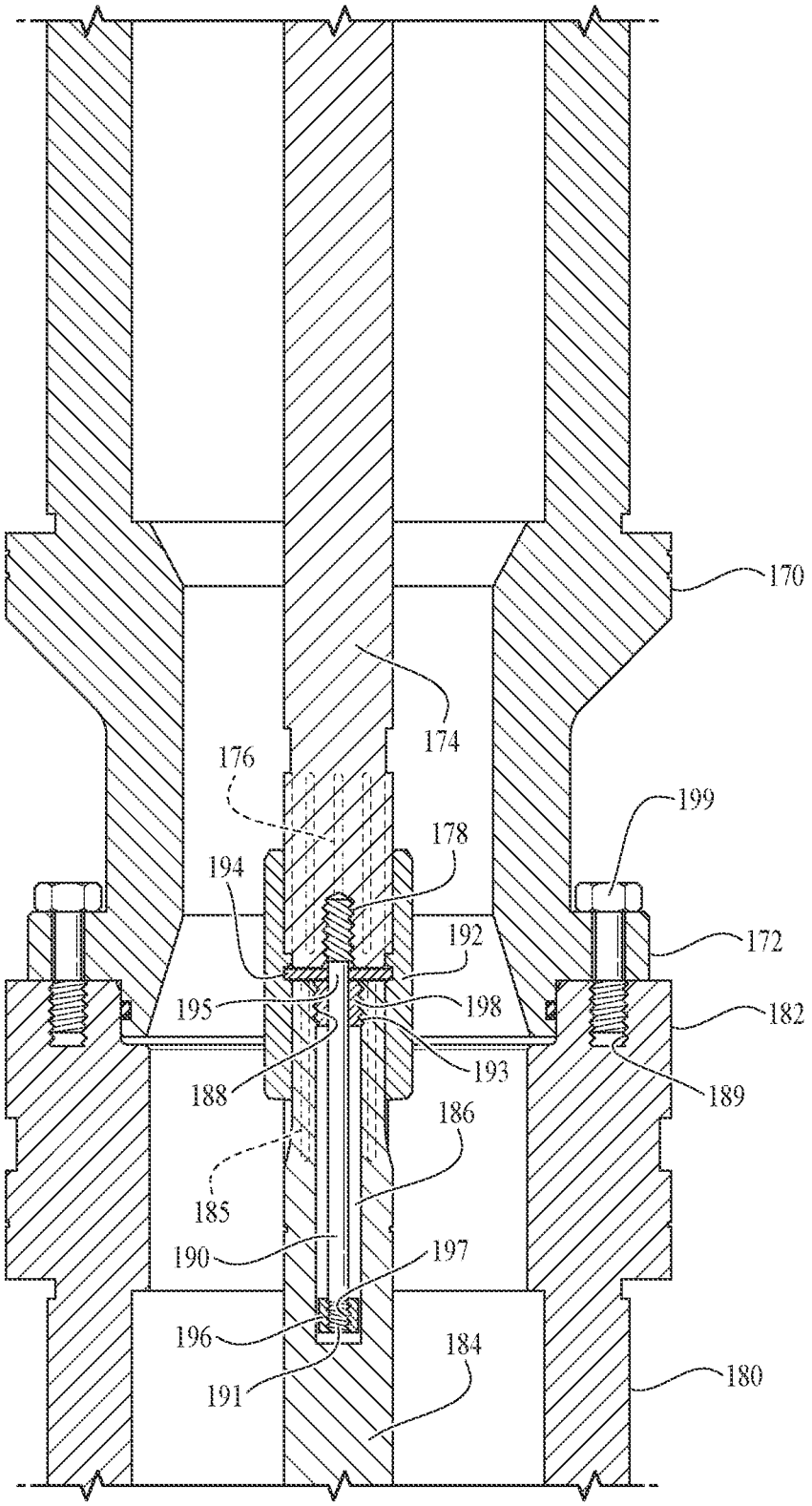
Figure 2F:
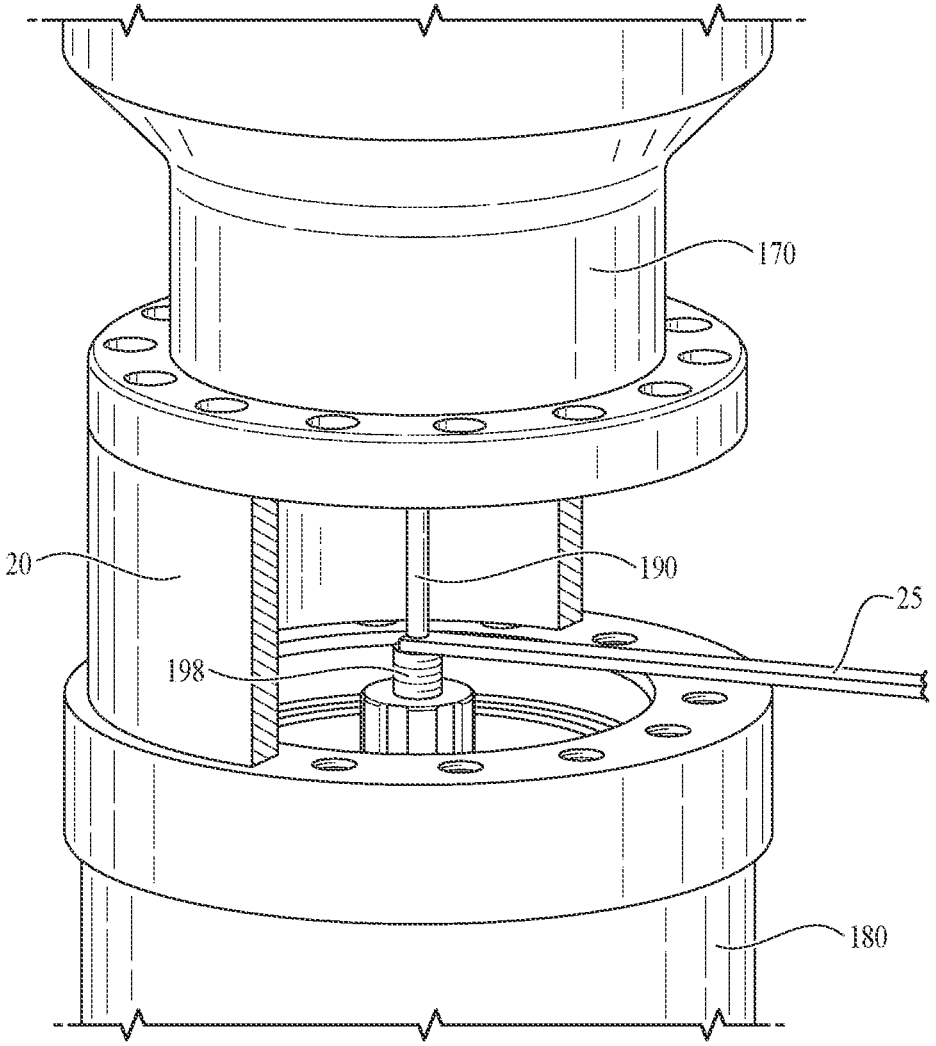

In an embodiment, a fixture 20 may be placed between the base 172 of the upper component 170 and the head 182 of the lower component 180 (see FIG. 2F) that securely separates the components 170, 180 while the tie rod 190, the coupling shell 192, the shaft plug 198, and the tie rod stop 196 are installed. The fixture may have a window of about 180 degrees angular displacement to allow tool access and turning space. In an embodiment, two fixtures similar to fixture 20 illustrated in FIG. 2F may be employed—a first fixture with a greater standoff distance used when coupling the upper end of the tie rod 190 to the lower end of the first drive shaft 174, sliding the through-hole 195 of the central plate 194 of the coupling shell 192 over the tie rod 190, sliding the shaft plug 198 over the tie rod 190, and coupling the tie rod stop 196 to the lower end of the tie rod 190 and a second fixture with a lesser standoff distance used when coupling the shaft plug 198 to the upper end of the second drive shaft 184. Spanner wrench 25 is shown in FIG. 2F turning shaft plug 198 to threadingly couple into the second drive shaft 184.

As the upper component 170 is brought together with the lower component 180 (see FIG. 2D), the tie rod 190 and the tie rod stop 196 slidingly enter the central bore 186 in the second drive shaft 184. When the upper component 170 is together with the lower component 180 (see FIG. 2E), bolts 199 may be passed through bolt holes 179 in the base 172, and threads of the bolts 199 threadingly couple with the female threads 189 of the head 182. When assembled in this way, the tie rod 190, the tie rod stop 196, and the shaft plug 198 form a tethering assembly that couples at a first end to one of the drive shafts and couples slidingly at a second end to the other of the drive shafts. In an embodiment, the maximum axial motion allowed between the lower component 180 and the upper component 170 by the tethering assembly when it is installed—the distance between when the upper component 170 and the lower component 180 are attached together (when the base 172 is bolted to the head 182) and when the lower component 180 has moved so the tethering assembly (e.g., the tie rod 190, the tie rod stop 196, and the shaft plug 198 are supporting the weight of the lower component 180 and possibly other components of the ESP assembly 132 attached below the lower component 180)—is between 4 inches and 4 feet, between 4 inches and 3 feet, between 4 inches and 2 feet, between 4 inches and 1.5 feet, between 4 inches and 1 foot, between 4 inches and 10 inches, between 4 inches and 8 inches, or between 4 inches and 6 inches. If later the upper component 170 and lower component 180 separate (e.g., if the bolts 199 fail or come uncoupled), the lower component 180 may be caught and held as the tie rod 190 and tie rod stop 196 retract from the central bore 186 and an upper end of the tie rod stop 196 butts up against a lower end of the shaft plug 198 that is retained by the threads 188 at the upper end of the central bore 186.

If the upper component 170 becomes separated from the lower component 180, the lower component 180 falls free downwards in the wellbore 102, the tie rod 190 slides out of the shaft plug 198, the tie rod stop 196 upwards in the bore 186 until it is stopped by the shaft plug 198, and the lower component 180 is then tethered to the upper component 170 by the tie rod 190, the tie rod stop 196, and the shaft plug 198. When the ESP assembly 132 is withdrawn from the wellbore 102, for example at the end of an expected service life or to perform maintenance, the lower component 180 can be supported (for example by slips in a floor of a workover rig or other support structure at the surface 158). The upper component 170 can be detached from the lower component 180 (e.g., bolts 199 can be removed from threaded holes 189). The upper component 170 can be lifted, the tie rod 190 and tie rod stop 196 can slide upwards within the bore 186. The shaft plug 198 can be unthreaded from female threads 188 at the upper end of the second drive shaft 184, and the upper component 170, now untethered from the lower component 180, may be lifted free of the lower component 180.

In an embodiment, the tie rod 190, the tie rod stop 196, and/or the shaft plug 198 may be made of steel, for example made of oxidation-corrosion resistant steel such as austenitic nickel-chromium-based superalloy steel. In an embodiment, the tie rod 190, the tie rod stop 196, and/or the shaft plug 198 may be made of INCONEL. In an embodiment, the tie rod 190 may be a multi-strand cable.

It will be appreciated that the teachings of the present disclosure would continue to apply if the axial disposition of the tie rod 190, the tie rod stop 196, and the shaft plug 198 were reversed. For example, the male threads 191 on the lower end of the tie rod 190 may threadingly couple to a female threaded bore in the lower drive shaft 184; the tie rod 190 may pass through the through-hole 195. of the central plate 194; the shaft plug 198 may pass over the upper end of the tie rod 190 above the central plate 194; the female threads 197 of the tie rod stop 196 may threadingly couple to the male threads in the upper end of the tie rod 190; and the shaft plug 198 may threadingly couple to female threads 178 in the axial center bore in the lower end of the first drive shaft 174.

Figure 3:
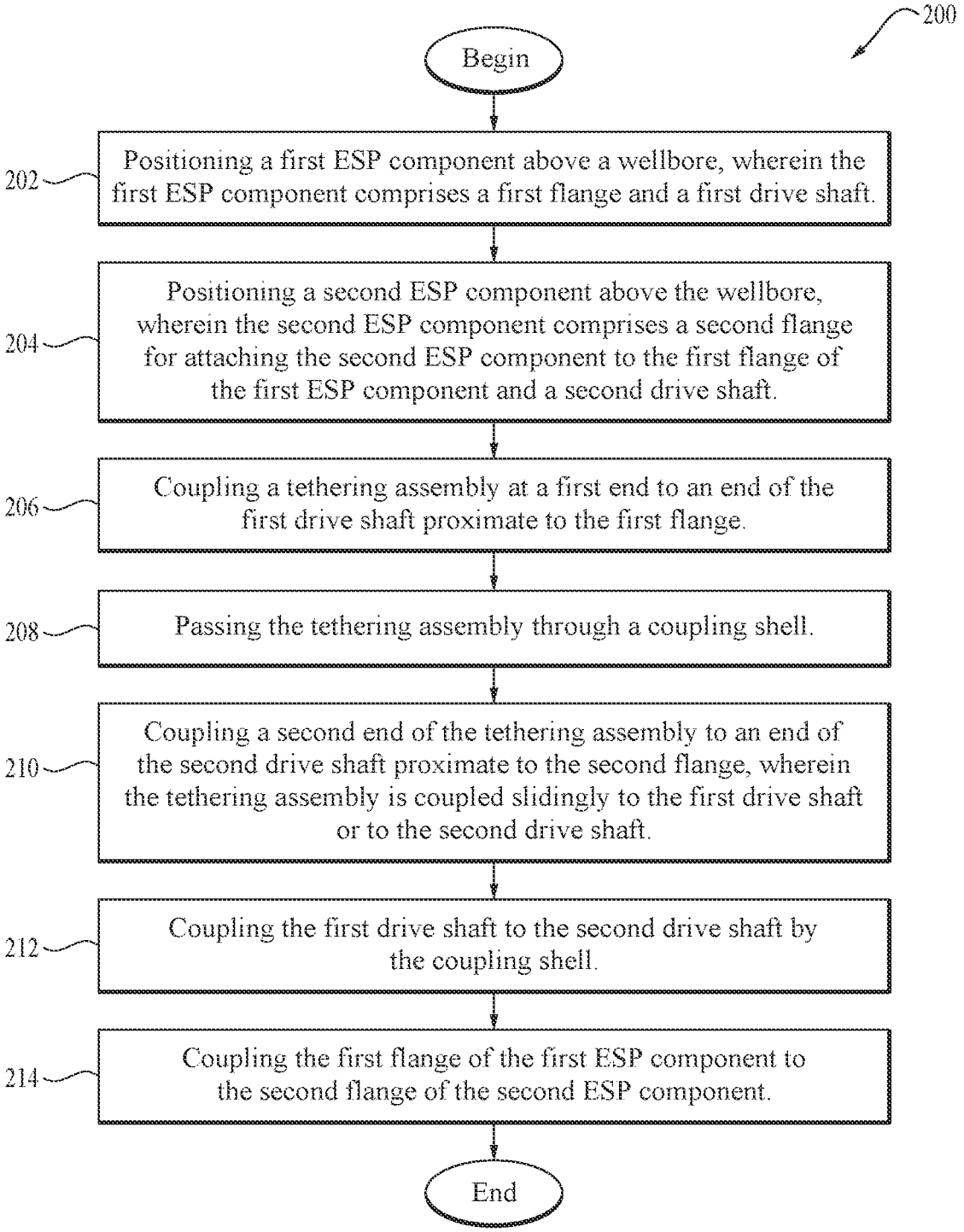
FIG. 3 is a flow chart of a method according to an embodiment of the disclosure.

Turning now to FIG. 3, a method 200 is described. In an embodiment, the method 200 is a method of assembling an electric submersible pump (ESP) assembly. At block 202, the method 200 comprises positioning a first ESP component above a wellbore, wherein the first ESP component comprises a head and a first drive shaft. At block 204, the method 200 comprises positioning a second ESP component above the first ESP component, wherein the second ESP component comprises a base for attaching the second ESP component to the head of the first ESP component and a second drive shaft. In some contexts, the first ESP component may be referred to as a first ESP assembly component, and the second ESP component may be referred to as a second ESP assembly component.

At block 206, the method 200 comprises coupling a tethering assembly at a first end to an end of the first drive shaft proximate to the first flange. In an embodiment, proximate to the first flange means an end of the first drive shaft that is within 3 feet of the first flange, and the first drive shaft has two ends. At block 208, the method 200 comprises passing the tethering assembly through a coupling shell. At block 210, the method 200 comprises coupling a second end of the tethering assembly to an end of the second drive shaft proximate to the second flange, wherein the tethering assembly is coupled slidingly to the first drive shaft or to the second drive shaft. In an embodiment, proximate to the second flange means an end of the second drive shaft that is within 3 feet of the second flange, and the second drive shaft has two ends.

At block 212, the method 200 comprises coupling the first drive shaft to the second drive shaft by the coupling shell. The coupling shell rotationally couples the first drive shaft to the second drive shaft. At block 214, the method 200 comprises coupling the first flange of the first ESP component to the second flange of the second ESP component. In an embodiment, the processing of blocks 206, 208, and 210 comprise passing a tie rod through the coupling shell; coupling a first end of the tie rod to one of the first drive shaft or the second drive shaft; passing a shaft plug having a through-hole over a second end of the tie rod; coupling a tie rod stop to the second end of the tie rod; and coupling the shaft plug to one of the second drive shaft or the first drive shaft. In the case that the processing at block 208 couples the first end of the tie rod to the first drive shaft, the processing of block 214 couples the shaft plug to the second drive shaft. In the case that the processing at block 208 couples the first end of the tie rod to the second drive shaft, the processing of block 214 couples the shaft plug to the first drive shaft.

Figure 4:
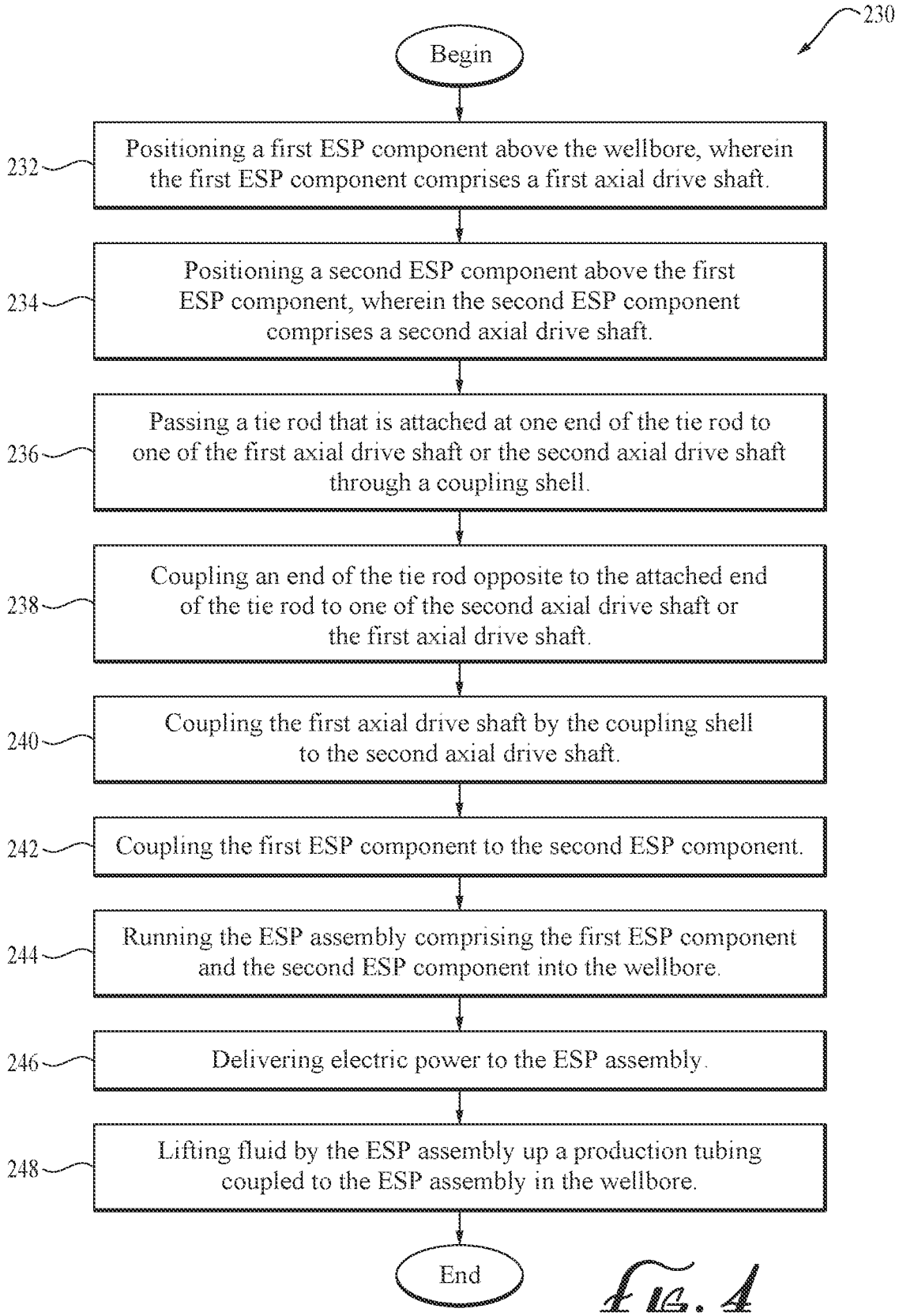
FIG. 4 is a flow chart of another method according to an embodiment of the disclosure.

Turning now to FIG. 4, a method 230 is described. In an embodiment, the method 230 is a method of lifting fluid by an electrical submersible pump (ESP) assembly in a wellbore. At block 232, the method 230 comprises positioning a first ESP component above the wellbore, wherein the first ESP component comprises a first drive shaft. At block 234, the method 230 comprises positioning a second ESP component above the first ESP component, wherein the second ESP component comprises a second drive shaft. In some contexts, the first ESP component may be referred to as a first ESP assembly component, and the second ESP component may be referred to as a second ESP assembly component.

At block 236, the method 230 comprises passing a tie rod that is attached at one end of the tie rod to one of the first drive shaft or the second drive shaft through a coupling shell. At block 238, the method 230 comprises coupling an end of the tie rod opposite to the attached end of the tie rod to one of the second drive shaft or the first drive shaft.

At block 240, the method 230 comprises coupling the first drive shaft by the coupling shell to the second drive shaft. At block 242, the method 230 comprises coupling the first ESP component to the second ESP component.

At block 244, the method 230 comprises running the ESP assembly comprising the first ESP component and the second ESP component into the wellbore. At block 246, the method 230 comprises delivering electric power to the ESP assembly. At block 248, the method 230 comprises lifting fluid by the ESP assembly up a production tubing coupled to the ESP assembly in the wellbore.

Additional Disclosure

A first embodiment which is An electric submersible pump (ESP) assembly, comprising: a first ESP assembly component comprising a first flange and a first drive shaft having first male splines at an end of the first drive shaft proximate to the first flange; a second ESP assembly component comprising a second flange for attaching the second ESP assembly component to the first flange of the first ESP assembly component and a second drive shaft having second male splines at an end of the second drive shaft proximate to the second flange; a coupling shell having a first set of female splines for mating with the first male splines of the first drive shaft and for coupling the first drive shaft to the second drive shaft, a second set of female splines for mating with the second male splines of the second drive shaft; and a tethering assembly that is coupled at a first end to the end of the first drive shaft proximate to the first flange, passing through the coupling shell, and coupled slidingly at a second end to the end of the second drive shaft proximate to the second flange.

A second embodiment which is The ESP assembly of the first embodiment, wherein the tether assembly comprises: a tie rod coupled at a first end to the end of the first drive shaft proximate to the first flange; a tie rod stop coupled to a second end of the tie rod; and a shaft plug coupled to the end of the second drive shaft proximate to the second flange, wherein the shaft plug has a through-hole, wherein the tie rod passes through the through-hole of the shaft plug, and the shaft plug is disposed between the tie rod stop and the plate of the coupling shell.

A third embodiment, which is the ESP assembly of the first embodiment, wherein the first ESP assembly component is a pump assembly and the second ESP assembly component is a seal section.

A fourth embodiment, which is the ESP assembly of the first embodiment, wherein the first ESP assembly component is a seal section and the second ESP assembly component is an electric motor.

A fifth embodiment, which is The ESP assembly of the fourth embodiment, further comprising: a third ESP assembly component comprising a third flange and a third drive shaft having third male splines at an end of the third drive shaft proximate to the third flange, wherein the first ESP assembly component comprises a fourth flange for attaching the first ESP assembly component to the third flange of the third ESP assembly component and the first drive shaft has fourth male splines at an end of the first drive shaft proximate to the fourth flange; a second coupling shell having a third set of female splines for mating with the third male splines of the third drive shaft and for coupling the third drive shaft to the first drive shaft, a fourth set of female splines for mating with the fourth male splines of the first drive shaft; a second tether assembly that is coupled at a first end to the end of the third drive shaft proximate to the third flange, passing through the second coupling shell, and coupled slidingly at a second end to the end of the first drive shaft proximate to the fourth flange.

A sixth embodiment, which is the ESP assembly of the fifth embodiment, wherein the third ESP assembly component is a pump assembly.

A seventh embodiment, which is the ESP assembly of the fifth embodiment, wherein the third ESP assembly component is a gas separator.

An eighth embodiment, which is the ESP assembly of the first embodiment, wherein the first ESP assembly component is a pump assembly and the second ESP assembly component is a gas separator.

A ninth embodiment, which is A method of assembling an electric submersible pump (ESP) assembly, comprising: positioning a first ESP component above a wellbore, wherein the first ESP component comprises a first flange and a first drive shaft; positioning a second ESP component above the wellbore, wherein the second ESP component comprises a second flange for attaching the second ESP component to the first flange of the first ESP component and a second drive shaft; coupling a tethering assembly at a first end to an end of the first drive shaft proximate to the first flange; passing the tethering assembly through a coupling shell; coupling a second end of the tethering assembly to an end of the second drive shaft proximate to the second flange, wherein the tethering assembly is coupled slidingly to the first drive shaft or to the second drive shaft; coupling the first drive shaft to the second drive shaft by the coupling shell; and coupling the first flange of the first ESP component to the second flange of the second ESP component.

A tenth embodiment, which is the method of the ninth embodiment, wherein the first ESP component is an electric motor and the second ESP component is a seal section.

An eleventh embodiment, which is the method of the ninth embodiment, wherein the first ESP component is a seal section and the second ESP component is an electric motor.

A twelfth embodiment, which is the method of the ninth embodiment, wherein the first ESP component is a seal section and the second ESP component is a pump assembly.

A thirteenth embodiment, which is the method of the ninth embodiment, wherein the first ESP component is a pump assembly and the second ESP component is a seal section.

A fourteenth embodiment, which is the method of the ninth embodiment, wherein the first ESP component is a gas separator and the second ESP component is a pump assembly.

A fifteenth embodiment, which is the method of the ninth embodiment, wherein the first ESP component is a pump assembly and the second ESP component is a gas separator.

A sixteenth embodiment, which is a method of lifting fluid by an electrical submersible pump (ESP) assembly in a wellbore, comprising: positioning a first ESP component above the wellbore, wherein the first ESP component comprises a first drive shaft; positioning a second ESP component above the first ESP component, wherein the second ESP component comprises a second drive shaft; passing a tie rod that is attached at one end of the tie rod to one of the first drive shaft or the second drive shaft through a coupling shell; coupling an end of the tie rod opposite to the attached end of the tie rod to one of the second drive shaft or the first drive shaft; coupling the first drive shaft by the coupling shell to the second drive shaft; coupling the first ESP component to the second ESP component; running the ESP assembly comprising the first ESP component and the second ESP component into the wellbore; delivering electric power to the ESP assembly; and lifting fluid by the ESP assembly up a production tubing coupled to the ESP assembly in the wellbore.

A seventeenth embodiment, which is the method of the sixteenth embodiment, wherein when the tie rod is attached at one end of the tie rod to the first drive shaft, coupling an end of the tie rod opposite to the attached end of the tie rod comprises coupling the end of the tie rod opposite to the attached end of the tie rod to the second drive shaft.

An eighteenth embodiment, which is the method of the sixteenth embodiment, wherein when the tie rod is attached at one end of the tie rod to the second drive shaft, coupling an end of the tie rod opposite to the attached end of the tie rod comprises coupling the end of the tie rod opposite to the attached end of the tie rod to the first drive shaft.

A nineteenth embodiment, which is the method of the sixteenth embodiment, wherein the tie rod is attached at one end because it is contiguous with one of the first drive shaft or the second drive shaft.

A twentieth embodiment, which is the method of the sixteenth embodiment, wherein the first ESP component is a seal section and the second ESP component is a pump assembly.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An electric submersible pump (ESP) assembly, comprising:

a first ESP assembly component comprising a first flange and a first drive shaft having first male splines at an end of the first drive shaft proximate to the first flange;

a second ESP assembly component comprising a second flange for attaching the second ESP assembly component to the first flange of the first ESP assembly component and a second drive shaft having second male splines at an end of the second drive shaft proximate to the second flange;

a coupling shell having a first set of female splines for mating with the first male splines of the first drive shaft and for coupling the first drive shaft to the second drive shaft, a second set of female splines for mating with the second male splines of the second drive shaft; and a tethering assembly that is coupled at a first end to the end of the first drive shaft proximate to the first flange, passing through the coupling shell, and coupled slidingly at a second end to the end of the second drive shaft proximate to the second flange, wherein the tethering assembly defines a limit to the axial motion that can occur between the first ESP assembly component and the second ESP assembly component before the tethering assembly stops the axial motion, and where the tethering assembly is configured to support the weight of one of the first ESP assembly component or of the second ESP assembly component.

2. The ESP assembly of claim 1, wherein the tether assembly comprises:

a tie rod coupled at a first end to the end of the first drive shaft proximate to the first flange;

a tie rod stop coupled to a second end of the tie rod; and a shaft plug coupled to the end of the second drive shaft proximate to the second flange, wherein the shaft plug has a through-hole, wherein the tie rod passes through the through-hole of the shaft plug, and the shaft plug is disposed between the tie rod stop and a plate of the coupling shell.

3. The ESP assembly of claim 1, wherein the first ESP assembly component is a pump assembly and the second ESP assembly component is a seal section.

4. The ESP assembly of claim 1, wherein the first ESP assembly component is a seal section and the second ESP assembly component is an electric motor.

5. The ESP assembly of claim 4, further comprising:

a third ESP assembly component comprising a third flange and a third drive shaft having third male splines at an end of the third drive shaft proximate to the third flange, wherein the first ESP assembly component comprises a fourth flange for attaching the first ESP assembly component to the third flange of the third ESP assembly component and the first drive shaft has fourth male splines at an end of the first drive shaft proximate to the fourth flange;

a second coupling shell having a third set of female splines for mating with the third male splines of the third drive shaft and for coupling the third drive shaft to the first drive shaft, a fourth set of female splines for mating with the fourth male splines of the first drive shaft;

a second tether assembly that is coupled at a first end to the end of the third drive shaft proximate to the third flange, passing through the second coupling shell, and coupled slidingly at a second end to the end of the first drive shaft proximate to the fourth flange.

6. The ESP assembly of claim 5, wherein the third ESP assembly component is a pump assembly.

7. The ESP assembly of claim 5, wherein the third ESP assembly component is a gas separator.

8. The ESP assembly of claim 1, wherein the first ESP assembly component is a pump assembly and the second ESP assembly component is a gas separator.

9. The ESP assembly of claim 1, wherein the tethering assembly defines a limit to the axial motion that can occur between the first ESP assembly component and the second ESP assembly component before the tether assembly stops the axial motion of between 4 inches and 4 feet.

10. A method of assembling an electric submersible pump (ESP) assembly, comprising:

positioning a first ESP component above a wellbore, wherein the first ESP component comprises a first flange and a first drive shaft;

positioning a second ESP component above the wellbore, wherein the second ESP component comprises a second flange for attaching the second ESP component to the first flange of the first ESP component and a second drive shaft;

coupling a tethering assembly at a first end to an end of the first drive shaft proximate to the first flange, wherein the tethering assembly defines a limit to the axial motion that can occur between the first ESP component and the second ESP component before the tethering assembly stops the axial motion, and where the tethering assembly is configured to support the weight of one of the first ESP component or of the second ESP component;

passing the tethering assembly through a coupling shell;

coupling a second end of the tethering assembly to an end of the second drive shaft proximate to the second flange, wherein the tethering assembly is coupled slidingly to the first drive shaft or to the second drive shaft;

coupling the first drive shaft to the second drive shaft by the coupling shell; and coupling the first flange of the first ESP component to the second flange of the second ESP component.

11. The method of claim 10, wherein the first ESP component is an electric motor and the second ESP component is a seal section.

12. The method of claim 10, wherein the first ESP component is a seal section and the second ESP component is an electric motor.

13. The method of claim 10, wherein the first ESP component is a seal section and the second ESP component is a pump assembly.

14. The method of claim 10, wherein the first ESP component is a pump assembly and the second ESP component is a seal section.

15. The method of claim 10, wherein the first ESP component is a gas separator and the second ESP component is a pump assembly.

16. The method of claim 10, wherein the first ESP component is a pump assembly and the second ESP component is a gas separator.

17. A method of lifting fluid by an electrical submersible pump (ESP) assembly in a wellbore, comprising:

positioning a first ESP component above the wellbore, wherein the first ESP component comprises a first drive shaft;

positioning a second ESP component above the first ESP component, wherein the second ESP component comprises a second drive shaft;

passing a tie rod that is attached at one end of the tie rod to one of the first drive shaft or the second drive shaft through a coupling shell;

coupling an end of the tie rod opposite to the attached end of the tie rod to one of the second drive shaft or the first drive shaft;

coupling the first drive shaft by the coupling shell to the second drive shaft;

coupling the first ESP component to the second ESP component;

running the ESP assembly comprising the first ESP component and the second ESP component into the wellbore;

delivering electric power to the ESP assembly; and lifting fluid by the ESP assembly up a production tubing coupled to the ESP assembly in the wellbore.

18. The method of claim 17, wherein when the tie rod is attached at one end of the tie rod to the first drive shaft, coupling an end of the tie rod opposite to the attached end of the tie rod comprises coupling the end of the tie rod opposite to the attached end of the tie rod to the second drive shaft.

19. The method of claim 17, wherein when the tie rod is attached at one end of the tie rod to the second drive shaft, coupling an end of the tie rod opposite to the attached end of the tie rod comprises coupling the end of the tie rod opposite to the attached end of the tie rod to the first drive shaft.

20. The method of claim 17, wherein the tie rod is attached at one end because it is contiguous with one of the first drive shaft or the second drive shaft.

21. The method of claim 17, wherein the first ESP component is a seal section and the second ESP component is a pump assembly.

* * * * *